US007806554B2

(12) United States Patent
Chang et al.

(10) Patent No.: US 7,806,554 B2
(45) Date of Patent: Oct. 5, 2010

(54) LED DIRECT-PLUGGING TYPE MULTI-CHIP HIGH POWER LIGHT SOURCE

(75) Inventors: Baoyan Chang, Guangdong (CN); Xianghong Yang, Honghu (CN); Zheng Xu, Honghu (CN)

(73) Assignee: Shenzhen Hongya Opto Electronic Co., Ltd., Guangdong (CN)

( * ) Notice: Subject to any disclaimer, the term of this patent is extended or adjusted under 35 U.S.C. 154(b) by 259 days.

(21) Appl. No.: 12/043,409

(22) Filed: Mar. 6, 2008

(65) Prior Publication Data

US 2009/0010010 A1 Jan. 8, 2009

(30) Foreign Application Priority Data

Jul. 2, 2007 (CN) ..... 2007 2 0121161 U

(51) Int. Cl.
*F21L 4/00* (2006.01)

(52) U.S. Cl. ..... 362/158; 362/103; 362/294

(58) Field of Classification Search ..... 362/806, 362/218, 158, 294, 373, 103; 257/99, 198
See application file for complete search history.

(56) References Cited

U.S. PATENT DOCUMENTS

| | | | | |
|---|---|---|---|---|
| 6,936,855 | B1 * | 8/2005 | Harrah | 257/88 |
| 2005/0068776 | A1 * | 3/2005 | Ge | 362/296 |
| 2006/0126328 | A1 * | 6/2006 | Coushaine | 362/247 |
| 2006/0139935 | A1 * | 6/2006 | Huang | 362/373 |
| 2007/0023766 | A1 * | 2/2007 | Aruga et al. | 257/81 |
| 2007/0165408 | A1 * | 7/2007 | Li | 362/294 |
| 2008/0074883 | A1 * | 3/2008 | Li | 362/294 |
| 2008/0217643 | A1 * | 9/2008 | Lin et al. | 257/99 |
| 2008/0285269 | A1 * | 11/2008 | Chan | 362/235 |

FOREIGN PATENT DOCUMENTS

JP 06-314857 * 8/1994

* cited by examiner

*Primary Examiner*—Jong-Suk (James) Lee
*Assistant Examiner*—Julie A Shallenberger
(74) *Attorney, Agent, or Firm*—Jackson IPG PLLC; Demian K. Jackson

(57) ABSTRACT

The present invention provides a LED direct-plugging type multi-chip high power light source, comprising a heat dissipating substrate, a protective rubber ring mounted at the front side of the heat dissipating substrate, LEDs fixed on the heat dissipating substrate and in the protective rubber ring, the heat dissipating substrate being provided with two through holes penetrating its front side and rear side, in each of the two through holes separately provided with a pin connected to the LEDs, one end of the pin inserted into the through hole and the other end of the pin led out from the rear side of the heat dissipating substrate to the outside of the heat dissipating substrate, and the part of the pins inserted in the through holes being separated from the heat dissipating substrate by a insulator. The heat dissipating substrate is made of high heat conduction metal. In the present invention, the heat dissipating substrate is made of high heat conduction metal, and the heat conducting pole is abolished. Comparing with the conventional art, the present invention decreases the heat dissipating path, increases the sectional area, and eliminates the intermediate link of high thermal resistance. The present invention increases the power of a single light source, decreases the attenuation of light greatly, and increases the useful life greatly.

4 Claims, 2 Drawing Sheets

LED DIRECT-PLUGGING TYPE MULTI-CHIP HIGH POWER LIGHT SOURCE

RELATED APPLICATIONS

The present application is based on, and claims priority from, China Application Number 200720121161.1, filed Jul. 2, 2007, the disclosure of which is hereby incorporated by reference herein in its entirety.

BACKGROUND OF THE INVENTION

1. Field of the Invention

The present invention relates to an illuminating device, particularly relates to a high power LED light source.

2. Description of the Related Art

As a new type of light source, LED gradually concerns all the countries in the world. Comparing with the traditional light source, LED involves the advantages: 1, having better safety, belonging to cold light source device, being driven in low voltage, having firm structure, not falling to pieces; having long useful life, lasting 50-100 thousand hours in a good heat dissipation condition, which is much longer than other light sources; 2, having rich colors, being regulated and controlled easily; 3, improving luminous efficiency greatly year after year, the general products achieving 60-80 lm/w now, which is much better than incandescent lamps of 15 lm/w, equaling 80 lm/w of fluorescent lamp with best luminous efficiency, and to exceed the luminous efficiency of other light sources is just a matter of time; 4, protecting the environment, having no heavy metal pollutions in waste materials, according with the standard of EU ROSH.

As a semiconductor device, LED has the inherent disadvantage of not enduring heat. Especially for the high power device, if failed to conduct and emit the heat generated in working, the temperature of the PN junction will rise leading to the great dropping in luminous efficiency; if the temperature of the PN junction is over 120° C., with time passing by unrecoverable attenuation of light or even dying of the lamp will occur, and it is very common that after 1000 hours the brightness will decrease over 50%. A familiar LED light source structure, as illustrated in FIG. 1, comprises a chip bonding plane 01, a heat conducting pole 02, a heat dissipating substrate 03, and a user radiator 04. The structure comprises disadvantages that sectional area of the heat conducting pole 02 is small, the heat conducting path is long, and the thermal resistance is great. Commonly, silicone 05 is used to connect between the heat conducting pole 02 and the heat dissipating substrate 03, even if tin-lead solders were used, that will become a big thermal resistance region. For the thermal resistance is great, the structure can only conduct limited heat. So with the structure, only 1-3 W light source can be produced, and the light source of above 5 W will have short useful life due to absence of conducting heat.

SUMMARY OF THE INVENTION

The present invention provides a LED direct-plugging type multi-chip high power light source with good heat dissipating capability, to solve the technical problem that the conventional LED lamps have bad heat dissipating capability and can not afford the high power LED to dissipate heat.

To solve the above problem, the technical solution of the present invention is to construct a LED direct-plugging type multi-chip high power light source, comprising a heat dissipating substrate, a protective rubber ring mounted at the front side of the heat dissipating substrate, LEDs fixed on the heat dissipating substrate and in the protective rubber ring, the heat dissipating substrate being provided with two through holes penetrating its front side and rear side, in each of the two through holes separately provided with a pin connected to the LEDs, one end of the pin inserted into the through hole and the other end of the pin led out from the rear side of the heat dissipating substrate to the outside of the heat dissipating substrate, and the part of the pins inserted in the through holes being separated from the heat dissipating substrate by a insulator.

Wherein a raised truncated cone is set in the middle of the heat dissipating substrate, a number of LEDs are set on the surface of the truncated cone, are divided into a number of groups;

the LEDs of each group are connected to each other in series, and are connected to the pins via conductors.

The protective rubber ring has a circular hoop shape, and an electroplated coating is set at the internal wall surface of the protective rubber ring.

The insulator is a glass insulating ring formed by sintering of glass to fill between the pins and the heat dissipating substrate.

The heat dissipating substrate is made of high heat conduction metal.

The pins has a straight bar shape.

In the present invention, the heat dissipating substrate is made of high heat conduction metal, and the heat conducting pole is abolished. Comparing with the conventional art, the present invention decreases the heat dissipating path, increases the sectional area, and eliminates the intermediate link of high thermal resistance. The glass insulating ring 5 formed by sintering of glass can fill the interspaces well, can withstand high voltage, have no leakage, and have high mechanical strength while separating the pins from the heat dissipating substrate to be insulated. The present invention increases the power of a single light source, decreases the attenuation of light greatly, increases the useful life greatly, and makes the LED being used in high power illuminating area.

Other objects, advantages and novel features of the present invention will be drawn from the following detailed embodiment of the present invention with attached drawings, in which:

DESCRIPTION OF THE PREFERRED EMBODIMENT

Figure 1:
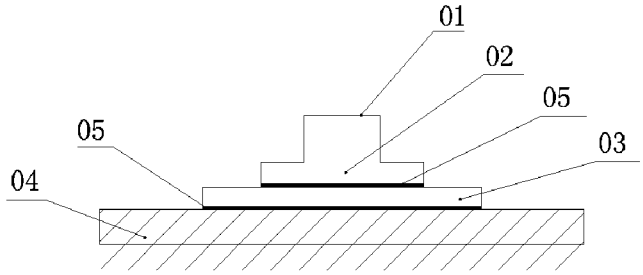
FIG. 1 (Prior Art)
FIG. 1 is a structure schematic diagram of a conventional LED lamp.
Figure 2:
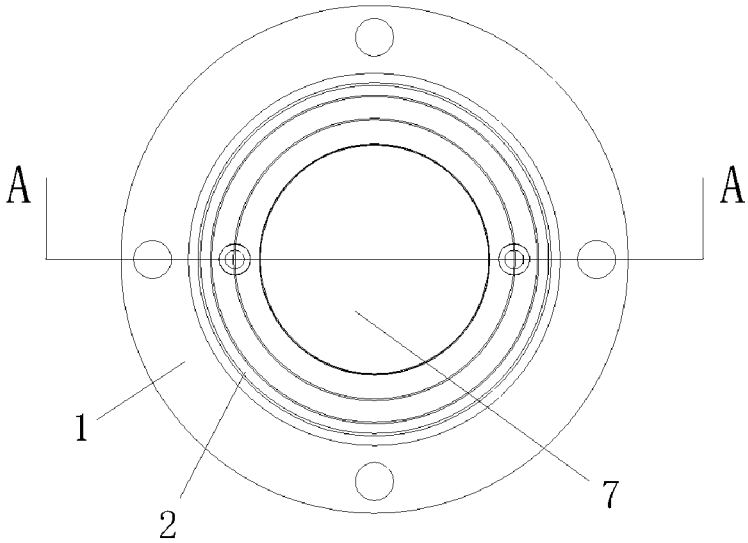
FIG. 2 is a front view of a preferred embodiment of the present invention.
Figure 3:
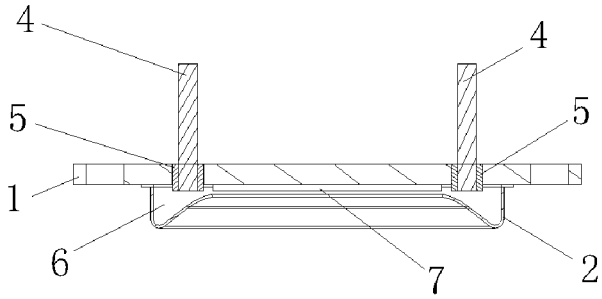
FIG. 3 is a sectional view of FIG. 2 along the line A-A.
Figure 6:
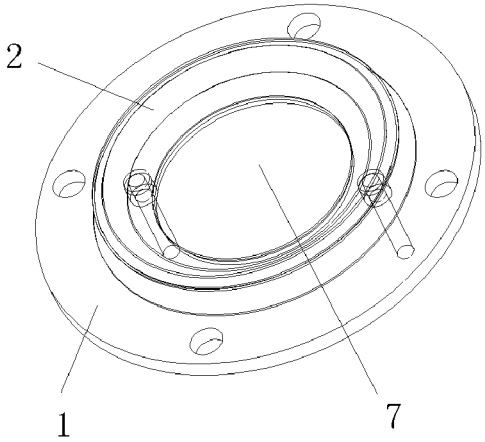
FIG. 6 is a stereogram schematic diagram of a preferred embodiment of the present invention.

As illustrated in FIG. 2, FIG. 3, and FIG. 6, the basic structure of a preferred embodiment of the present invention is showed. The LED direct-plugging type multi-chip high power light source comprises, a heat dissipating substrate 1, a protective rubber ring 2 mounted at the front side of the heat dissipating substrate 1, LEDs 3 mounted on the heat dissipating substrate 1 and in the protective rubber ring 2, the heat dissipating substrate 1 being provided with two through holes penetrating its front side and rear side, in each of the two through holes separately provided with a pin 4 connected to the LEDs 3, one end of the pin 4 inserted into the through hole and the other end of the pin 4 led out from the rear side of the heat dissipating substrate 1 to outside of the heat dissipating substrate, the part of the pin 4 inserted in the through holes being separated from the heat dissipating substrate 1 by a insulator 5.

Figure 4:
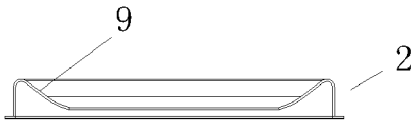
FIG. 4 is a structure schematic diagram of the protective rubber ring in a preferred embodiment of the present invention.
Figure 5:
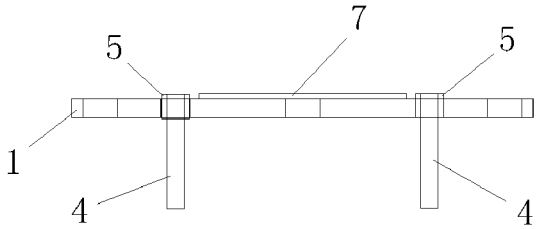
FIG. 5 is a structure schematic diagram of a part of the heat dissipating substrate in a preferred embodiment of the present invention.
Figure 7:
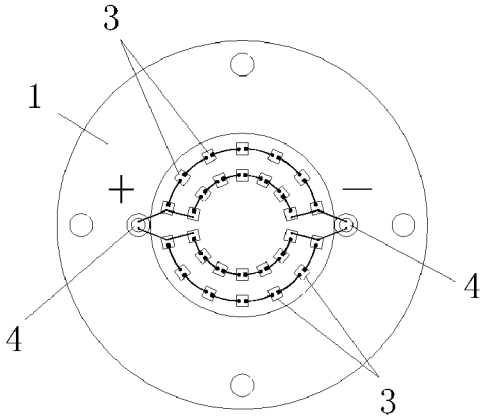
FIG. 7 is a schematic diagram of the LED connection in a preferred embodiment of the present invention.

As illustrated in FIG. 5, in the present embodiment the heat dissipating substrate 1 is made of high heat conduction metal, which has a round shape. There is a raised truncated cone 7 set in the middle of the heat dissipating substrate 1. A number of LEDs 3 are set on the surface of the truncated cone 7, and are divided into a number of groups. The LEDs 3 of each group are connected to each other in series, and each group is separately connected to the two pins 4 via conductors (referring to FIG. 7). The pin 4 has a column straight bar shape. The protective rubber ring 2 has a circular hoop shape. An electroplated coating 9 is set at the internal wall surface of the protective rubber ring 2, to enhance the light reflecting capability (as shown in FIG. 4).

In the present embodiment, the insulator 5 is a glass insulating ring 5 formed by sintering of glass to fill between the pins 4 and the heat dissipating substrate 1. The glass insulating ring 5 formed by sintering of glass can fill the interspaces well, and have high mechanical strength while separating the pins 4 from the heat dissipating substrate 1 to be insulated.

In the present invention, the heat dissipating substrate is made of high heat conduction metal, and the heat conducting pole is abolished. Comparing with the conventional art, the present invention decreases the heat dissipating path, increases the sectional area, and eliminates the intermediate link of high thermal resistance. The present invention increases the power of a single light source (the present structure increases the power from conventional below 5 W to 10 W-30 W), decreases the attenuation of light greatly (below 5% for 1000 hours), increases the useful life greatly (more than 20000 hours), and makes the LED being used in high power illuminating area. The present invention can also be used with the user radiator together.

What is claimed is:

1. A LED direct-plugging type multi-chip high power light source comprising a heat dissipating substrate, a protective rubber ring mounted at the front side of the heat dissipating substrate and a raised truncated cone set in the middle of the heat dissipating substrate, the protective rubber ring having a circular hoop shape, and an electroplated coating set at the internal wall surface of the protective rubber ring, a number of LEDs mounted on the surface of the truncated cone and in the protective rubber ring, the LEDs being divided into a number of groups and each group being connected to each other in series, the heat dissipating substrate being provided with two through holes penetrating its front side and rear side, in each of the two through holes separately provided with a pin connected to the LEDs via conductors, one end of the pin inserted into the through hole and the other end of the pin led out from the rear side of the heat dissipating substrate to outside of the heat dissipating substrate, the part of the pin inserted in the through holes being separated from the heat dissipating substrate by a insulator.

2. The LED direct-plugging type multi-chip high power light source of claim 1, wherein the insulator is a glass insulating ring formed by sintering of glass fill between the pins and the heat dissipating substrate.

3. The LED direct-plugging type multi-chip high power light source of claim 2, wherein the heat dissipating substrate is made of high heat conduction metal.

4. The LED direct-plugging type multi-chip high power light source of claim 3, wherein the pins have a straight base shape.

* * * * *